US010450526B2

(12) United States Patent
D'Acosta et al.

(10) Patent No.: US 10,450,526 B2
(45) **Date of Patent: *Oct. 22, 2019**

(54) AVIATION FUEL WITH A RENEWABLE OXYGENATE

(71) Applicant: Swift Fuels, LLC, West Lafayette, IN (US)

(72) Inventors: Chris D'Acosta, West Lafayette, IN (US); Thomas Albuzat, Homburg (DE)

(73) Assignee: SWIFT FUELS, LLC, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/800,223

(22) Filed: Nov. 1, 2017

(65) Prior Publication Data

US 2018/0051222 A1 Feb. 22, 2018

Related U.S. Application Data

(63) Continuation of application No. 14/798,624, filed on Jul. 14, 2015, now abandoned.

(60) Provisional application No. 62/024,028, filed on Jul. 14, 2014.

(51) Int. Cl.

| | |
|---|---|
| ***C10L 10/10*** | (2006.01) |
| ***C10L 1/02*** | (2006.01) |
| ***C10L 1/223*** | (2006.01) |
| ***C10L 1/16*** | (2006.01) |
| ***C10L 1/30*** | (2006.01) |

(52) U.S. Cl.

CPC ..... *C10L 10/10* (2013.01); *C10L 1/023* (2013.01); *C10L 1/1608* (2013.01); *C10L 1/223* (2013.01); *C10L 1/305* (2013.01); *C10L 2200/024* (2013.01); *C10L 2200/0259* (2013.01); *C10L 2270/04* (2013.01)

(58) Field of Classification Search

CPC combination set(s) only.

See application file for complete search history.

(56) References Cited

U.S. PATENT DOCUMENTS

| | | | | |
|---|---|---|---|---|
| 3,678,113 | A * | 7/1972 | Klopfer | C07C 209/68 564/315 |
| 2002/0005008 | A1 | 1/2002 | Studzinski et al. | |
| 2002/0045785 | A1 | 4/2002 | Bazzani et al. | |
| 2004/0107634 | A1 | 6/2004 | Binions | |
| 2005/0229480 | A1* | 10/2005 | Gaughan | C10L 1/14 44/412 |
| 2008/0134571 | A1 | 6/2008 | Landschof et al. | |
| 2010/0137668 | A1* | 6/2010 | Loescher | C07C 2/28 585/504 |
| 2011/0114536 | A1* | 5/2011 | Demoment | C10L 1/06 208/16 |
| 2012/0090226 | A1* | 4/2012 | Lamoureaux | C10L 1/02 44/452 |
| 2012/0238787 | A1* | 9/2012 | Gruber | C07C 1/24 585/14 |
| 2014/0123548 | A1* | 5/2014 | Braly | C10L 1/14 44/426 |

FOREIGN PATENT DOCUMENTS

| | | |
|---|---|---|
| WO | WO 991049003 A1 | 9/1999 |
| WO | WO 02/22786 A1 | 3/2002 |

* cited by examiner

*Primary Examiner* — Ellen M McAvoy
*Assistant Examiner* — Chantel L Graham
(74) *Attorney, Agent, or Firm* — Woodard, Emhardt, Henry, Reeves & Wagner, LLP

(57) ABSTRACT

Described are preferred compositions for a motor fuel. Such motor fuels may be particularly well suited for use in the motor of an aircraft. In particular, compositions of the present disclosure may comprise 50-75 wt % isooctane/alkylates, 20-40 wt % ETBE, 0-3 wt % isobutane, and 0-5 wt % aromatics. The present disclosure describes a full spectrum of unleaded fuels with various motor octane (MON) values.

8 Claims, No Drawings

AVIATION FUEL WITH A RENEWABLE OXYGENATE

REFERENCE TO RELATED APPLICATIONS

The present application claims priority to U.S. Provisional Patent Application Ser. No. 62/024,028, filed Jul. 14, 2014, the contents of which are hereby incorporated by reference.

FIELD OF THE INVENTION

The present invention relates to lead-free piston engine fuels (unleaded avgas) comprising aliphatic hydrocarbon components, typically including lower boiling $C_4$ to $C_{10}$ alkanes, alkenes, cycloalkanes and arenes found in gasoline, plus the use of oxygen-based heteroatomic compounds, particularly ETBE, blended together to produce unique avgas formulations with a 98 or higher motor octane number that offers excellent engine and operational performance for aviation purposes. These unique fuels are shown to have a) excellent piston-engine combustion and exhaust characteristics, b) lower environmental toxicity compared to aromatic amines or metals used as octane boosters, and c) a selectively high degree of fuel compatibility with materials used in aircraft fuel systems.

DESCRIPTION OF THE PRIOR ART

Motor fuels are used in a variety of systems. In the broadest sense, a motor fuel is one which is used in piston or turbine engines. The present invention is directed to fuels for piston engines useful in ground vehicles and/or aircraft. Typically, ground vehicles can use relatively lower octane fuels, while aircraft require higher octane fuels. A basic determinant as to the choice of fuels is the octane rating of the fuel compared to the compression of the engine. For example, higher compression engines generally require higher octane fuels.

A particular aspect of the present invention is to provide formulations which are useful as piston engine fuels, and are particularly suited for use as aviation gasoline.

Aviation gasoline, or avgas, has a number of special requirements as compared to ground vehicle gasoline. Aviation gasoline (called "avgas") is an aviation fuel used in spark-ignited (reciprocating) piston engines to propel aircraft. Avgas is distinguished from mogas (motor gasoline), which is the everyday gasoline used in motor vehicles and some light aircraft.

Most grades of avgas have historically contained tetraethyl lead (TEL), a toxic substance used to prevent engine knocking (detonation). This invention produces an unleaded grade of avgas with fuel properties that satisfy the appropriate combustion and anti-knocking requirements (detonation suppression), volatility (vapor pressure), and related criteria for piston engine aircraft as defined by ASTM D910 for 100LL (leaded avgas), but with a minimum 98 motor octane number. The inventive fuels allow a range of piston engine aircraft, including high-compression piston engines, to perform effectively to manufacturer requirements.

Aviation gasoline must meet the power demands for aircraft engines. The motor octane number, or MON, is a standard measure of the performance of an aviation fuel. The higher the MON, the more compression the fuel can withstand before detonating. In broad terms, fuels with a higher motor octane rating are most useful in high-compression engines that generally have higher performance.

The MON is a measure of how the fuel behaves when under load (stress). ASTM test method 2700 describes MON testing using a test engine with a preheated fuel mixture, 900 rpm engine speed, and variable ignition timing to stress the fuel's knock resistance. The MON of the aviation gasoline fuel can be used as a guide to the amount of knock-limiting power that may be obtained in a full-scale engine undertake-off, climb and cruise conditions.

Another particular issue with avgas is its ability to start reliably under a wide range of altitude and climate conditions. Avgas needs to have a lower and more uniform vapor pressure than automotive gasoline so it remains in the liquid state despite the reduced atmospheric pressure at high altitude, thus preventing vapor lock. The ability of an aviation gasoline to satisfy this requirement may be assessed based on the Reid Vapor Pressure (RVP). A typical requirement for avgas is that it have an RVP of 38-49 kPa at 37.8° C., as determined in accordance with ASTM D5191.

Avgas must also be highly insoluble in water. Water dissolved in aviation fuels can cause serious problems, particularly at altitude. As the temperature lowers, the dissolved water becomes free water. This then poses a problem if ice crystals form, clogging filters and other small orifices, which can result in engine failure.

Accordingly, ethanol and alcohol components are generally not used in aviation fuels due to their tendency to be water soluble, and some compounds are highly corrosive to fuel system components.

These fuels may optionally include other components or additives, particularly to modify or enhance characteristics such as octane rating, vapor pressure, viscosity, anti-icing, anti-static, oxidation stability, anti-corrosion, boiling point, engine cold start, exhaust smoke and engine deposits.

Aviation fuels are a product of blending many possible hydrocarbon components to very specific formulations to create a combustible fuel that is tailored for an aviation specific use. For example, turbine engines used on most commercial jets worldwide utilize jet fuels specifically design for their combustion characteristics using hydrocarbons with longer-chain molecules with carbons typically ranging between $C_8$ to $C_{16}$. These fuels typically have a high flash point (less flammable) which makes them safe for handling in a wide range of commercial uses. Piston engines used in general aviation require fuels made from lighter hydrocarbons (typically ranging from $C_4$ to $C_{10}$ carbon molecules) similar to gasolines used in automobiles, but with much higher octane requirements and somewhat lower vapor pressure requirements. For many decades the combustion characteristics of avgas used by piston engine aircraft has required tetraethyl-lead as a key component to the fuel to achieve the highest levels of motor octane number—thereby helping to reduce the likelihood of engine knocking. In recent years, the combination of public health hazards and environmental regulations has triggered an effort across the global aviation industry to remove all lead compounds from avgas.

The alternatives for blending and producing a lead-free aviation gasoline which meets the performance requirements for all varieties of piston engine aircraft are complex even for those schooled in the art of aviation gasolines. Aviation fuels used in piston engine aircraft must meet all minimum performance criteria as defined by various fuel specifications managed by ASTM International and overseen by a cross-industry forum of experts. The fuel must also meet minimum fuel operating requirements as defined by Federal Aviation Administration (FAA) and other federal, state and local regulators. Specifically the avgas must meet the minimum motor octane number to assure appropriate knock suppression under a range of engine performance requirements, the appropriate range for vapor pressure and all related matters impacting combustion, volatility, composition, fluidity, anti-corrosion, oxidation stability, environmental toxicology and material compatibility.

Compounds that have been found to enhance the motor octane rating of avgas for piston aircraft, as studied by those schooled in the art of aviation gasolines, include fuels with high concentrations of aromatic hydrocarbons (particularly methylbenzene, dimethylbenzene or 1,3,5-trimethylbenzene), or fuels blended with various aromatic amines (particularly aniline or meta-toluidine), oxygenates (e.g. MTBE, ETBE and Ethanol) and/or certain metals (particularly tetraethyl lead). This invention focuses on the use of base aliphatic compounds using specific $C_4$ to $C_{10}$ hydrocarbons, blended in the absence of nitrogen-based aromatic amines and in the absence of metals, but with the addition of very specific oxygen-based heteroatomic molecules (oxygenates) to achieve lead-free fuels that meet the appropriate ASTM specifications for aviation gasoline with a minimum 98 motor octane number. Furthermore the fuel is shown to be safe, low in toxicity, excellent combustion characteristics and fully compatible with materials used in aircraft fuel systems and the related supply chain.

U.S. Pat. No. 5,851,241 describes an unleaded aviation fuel comprised of base alkylate combined with an alkyl-tertiary-butyl-ether (typically MTBE or ETBE) in combination with up to 10% of an aromatic amine (e.g. aniline, m-toluidine, etc.); some derivative formulations also include the use manganese as an octane booster. Since MTBE and manganese has been largely banned in transportation fuels across many states in the US over the past 10 years, these formulations are not commercially viable in the marketplace. Furthermore, the use of high concentrations of aromatic amines brings concerns of environmental toxicity into the fuel formulations further challenging their acceptance as a fuel in the marketplace.

U.S. Pat. No. 6,238,446 describes various lead-free aviation fuels with a minimum 100 MON based upon a blend combination of base alkylate with 4% to 10% MTBE (or ETBE, or MTAE) plus the addition of 0.2-0.6 grams of manganese per gallon. This application fails to look at the high wear and tear impact of metals on the piston engine, or the impact these ethers like MTBE which are banned in the US marketplace. These factors make this invention impractical and commercially undesirable for aviation use.

US Patent Application No. 2008/0244963 A1 describes an unleaded fuel blended from a base aviation gasoline, with a minimum 100 MON, which contains various combination of alkylates, ethers, ether alcohols, anhydrides, aromatic ethers and ketones. Many of these fuel components have environmental toxicity issues that make this invention impractical and commercially undesirable for aviation use.

The Federal Aviation Administration (FAA) testing over a 10-year period, from 1990 to 2000, evaluated ETBE as a possible component for unleaded aviation gasoline. All ETBE-based formulations tested by the FAA program required the use of aromatics amines (i.e. m-toluidine) or tert-butyl-benzene to effectively boost the octane performance of the fuel for adequate piston engine anti-detonation performance.

Many other attempts have been made at devising a lead-free high-octane aviation gasoline starting from a hydrocarbon-based aviation fuel, some by combining lower boiling alkylates and aromatics up to 80% to increase the octane, as well as 5-15% of additional C4-05 compounds to adjust the vapor pressure to aviation gasoline standards. See, for example, U.S. Pat. Nos. 8,741,126, 7,416,568, 8,324,437, 8,049,048, and 8,686,202. Unlike these 5 hydrocarbon-specific fuel examples, the use of oxygenates combined with either MMT and/or aromatic amines into the base aviation fuel, as described in the prior art above, has resulted in a heightened concern industry wide to understand a broader view of the operational risks of these fuels on the aviation industry. That is what this selective research on ETBE and the associated invention herein has focused upon.

In light of this background, there remains a need for additional and/or improved fuel compositions.

SUMMARY OF THE INVENTION

In one aspect, the present invention provides for an improved fuel comprising ETBE and selected aliphatic hydrocarbons. For example, compositions of the present invention with a high motor octane number (MON) of 98 or above and suitable boiling point characteristics (impacting fuel stability, cold starting features, exhaust characteristics, etc.) may be useful as aviation fuel for many types of aircraft engines including high-performance engines and also legacy aircraft.

In another aspect, the present invention provides for an improved fuel that contains a minimal amount of lead compounds to achieve its optimal detonation suppression characteristics. For example, certain compositions of the present invention do not include the use of any tetraethyl lead or any ethylene dibromide to scavenge for the lead in the aircraft fuel system.

In still another aspect, the present invention provides for an improved fuel that meets or exceeds one or more requirements of ASTM D910 and/or ASTM D7719 and/or ASTM D7547.

Additional embodiments of the invention, as well as features and advantages thereof, will be apparent from the descriptions herein.

DETAILED DESCRIPTION

For the purposes of promoting an understanding of the principles of the invention, reference will now be made to certain embodiments and specific language will be used to describe the same. It will nevertheless be understood that no limitation of the scope of the invention is thereby intended, such alterations and further modifications, and such further applications of the principles of the invention as described herein being contemplated as would normally occur to one skilled in the art to which the invention relates.

ETBE is an aliphatic ether derived from the processing of ethanol (notably from bio-sources) and isobutylene. The ETBE molecular structure contains oxygen, hence it is called an oxygenate. ETBE has a positive impact on octane in the combustion of a piston engine. However, the energy density is about 5-8% less per gallon—resulting in a loss of aircraft range. This is reflected in a lower net heat of combustion measured by ASTM fuel standards. The oxygen in ETBE produces a favorable combustion affect, which tends to make a more complete combustion (thus emitting fewer unburned hydrocarbons in the exhaust). ETBE has favorable material compatibility features in that it is not aggressive in acting against the materials in an aircraft fuel system. ETBE has a water solubility of 1.2 g/100 g which can contribute to combustion issues in cold weather. Also, the boiling point of 71° C. results in some difficulty starting in extreme fuel with ETBE in cold weather situations. This is observed at the 10% boiling point (at 85° C., max) on the ASTM distillation curve test.

The present invention provides unleaded, piston engine fuels preferably comprising a mixture of select aliphatic hydrocarbons blended with ETBE. The aliphatic hydrocarbons may include alkanes, alkenes, alkynes, cycloalkanes and alkadienes. In preferred embodiments, the aliphatic hydrocarbons comprise lower boiling $C_4$ to $C_{10}$ alkanes, alkenes and cycloalkanes, but largely excluding arenes found in gasoline. The resulting fuel formulations are characterized by an array of desirable properties making them suitable for piston engines.

In certain aspects, the fuels comprise an alkylate product consisting of a variety of hydrocarbons. In refining, the alkylation process transforms low molecular-weight alkenes and iso-paraffin molecules into a product referred to as an "alkylate", which includes a mixture of high-octane, isoparaffins. As used herein, the term "alkylate" refers to the alkylate product available from a refinery, and also generally to any mixture including C4 to C10 non-aromatic hydrocarbons. Whether from the alkylate product of the refineries, or in more purified form, the inclusion of these high volatility/low boiling point components contributes to achieving a desired Reid Vapor Pressure (RVP) range.

In one aspect, the alkylate component comprises alkanes. In particular, it has been found that the C4-C10 alkanes, and more preferably branched alkanes, provide especially desirable properties for the inventive fuel formulations. Isooctane is particularly preferred in order to achieve a balance of desirable fuel properties.

Aspects of the present invention relate to compositions of fuel. More particularly, aspects of the present invention may be particularly applicable to fuel compositions used for aircraft, often called aviation gasoline or avgas. ASTM specification D7719 describes a fuel specification for high octane aviation fuel, and is hereby incorporated by reference in its entirety. ASTM D7719 also makes reference to documents, for example but not limited to other ASTM specifications, and these references are hereby incorporated by reference in their entirety. ASTM specification D7547 describes a fuel specification for unleaded aviation fuel. ASTM D7547 is hereby incorporated by reference in its entirety. ASTM D7547 also makes reference to documents, for example but not limited to other ASTM specifications and these references are hereby incorporated by reference in their entirety. ASTM specification D7592 describes a fuel specification for unleaded aviation fuel. ASTM D7592 is hereby incorporated by reference in its entirety. ASTM D7592 also makes reference to documents, for example but not limited to other ASTM specifications, and these references are hereby incorporated by reference in their entirety. ASTM specification D910 entitled "Standard Specification for Aviation Gasolines" describes several characteristics that an aviation gasoline may meet, and is hereby incorporated by reference in its entirety. ASTM D910 also makes reference to documents, for example but not limited to other ASTM specifications, and these references are also hereby incorporated by reference.

TABLE 1

| ASTM D7719 (UL 102) provides as follows: | | |
|---|---|---|
| D4809 | Net Heat of Combustion, MJ/kg Octane Rating | 41.5, min |
| D2700 | Knock value, lean mixture Motor Octane Number | 102.2, min |
| D2622 | Sulfur, mass % | 0.005, max |

TABLE 1-continued

| ASTM D7719 (UL 102) provides as follows: | | |
|---|---|---|
| D5059 | Tetraethyl lead, mL g Pb/L | 0.013, max |
| D5191 | Vapor pressure, 38° C., kPa | 38-49 |
| D1298 | Density at 15° C., kg/m3 | 790-825 |
| D86 | Distillation | |
| | Fuel Evaporated | |
| | 10, volume % at ° C. | 75, max |
| | 40, volume % at ° C. | 75, min |
| | 50, volume % at ° C. | 165, max |
| | 90, volume % at ° C. | 165, max |
| | Final boiling point, ° C. | 180, max |
| | Sum of 10% + 50% evaporated | 135, min |
| | Recovery, volume % | 97, min |
| | Residue, volume % | 1.5, max |
| | Loss, volume % | 1.5, max |
| D2386 | Freezing Point, ° C. | −58, max |
| D130 | Corrosion, copper strip, 2 h @ 100° C. | No. 1, max |
| D873 | Oxidation stability (5 h aging) Potential gum total, mg/100 mL | 6, max |
| D1094 | Water reaction, Volume change, mL | ±2, max |
| D2624 | Electrical conductivity, 19.9° C., pS/m | 450, max |

It has been found that the present fuel formulations have a minimum 98 motor octane number (MON) that satisfactorily supports anti-detonation tests in a full-scale engine test. Compositions of the present invention have a MON of at least 98 depending on the actual blend of components used. The fuel formulations have an RVP of 38 to 49 kPa at 37.8° C.

The unleaded fuel in the invention, also called "UL100R" or "100R" in Table 2, compares favorably to ASTM D910 Grade 100LL and ASTM D6227 Grade UL87 below with regard to performance properties in Table 1. For example, UL100R has a net heat of combustion minimum that is 2.7 MJ/kg lower than that for 100LL, and when converted to a volume basis (MJ/L), the net heat of combustion is actually 5-8% lower than 100LL. Research has indicated that the presence of an oxygenate in the fuel results in a more complete combustion, which offsets some of the effect of the reduced net heat of combustion. The impact of the more complete combustion, on a per gallon basis, allows the range of flight of the aircraft to be equivalent to that of 100LL while the exhaust emissions are far cleaner with UL100R (i.e., no lead exhaust, and lower unburned hydrocarbons in the exhaust due to the presence of oxygen at the time of combustion). While UL100R has a minimum MON of 98, the presence of an oxygenate results in improved combustion performance, which provides some knock resistance enhancement compared to a non-oxygenated fuel of equivalent MON.

UL100R is an unleaded fuel that allows for up to 0.013 gPb/L maximum in case of accidental contamination between the refinery and the FBO, whereas 100LL is a leaded fuel that contains up to 0.56 gPb/L. UL100R, being an unleaded fuel, will have zero lead precipitate. UL100R is an oxygenated fuel, containing up to 40% (m/m) ethyl tert-butyl ether (ETBE), which is preferably made from bio-ethanol and isobutylene; therefore, with 40% ETBE in the fuel, any ETBE derived from corn ethanol is calculated as 18% sourced from renewable feedstocks. It will be appreciated, however, that the present invention is not restricted to the use of ETBE obtained from any particular source. ETBE alone has been endorsed by the FAA as a viable fuel component despite market concerns about continued multi-state bans of MTBE.

TABLE 2

Comparison of UL100R to ASTM D910 (Grade 100LL) and ASTM D6227 (Grade UL87)

| ASTM Test Method | ASTM Requirements | Leaded ASTM D910 | Unleaded ASTM D6227 | Unleaded UL100R |
|---|---|---|---|---|
| | Grade | 100LL, Avgas | UL87 | UL100 R |
| | COMBUSTION | | | |
| D4809 | Net Heat of Combustion, MJ/kg | 43.5, min | 40.8, min | 40.8, min |
| | Octane Rating | | | |
| D2700 | Knock value, lean mixture | | | |
| | Motor Octane Number | 99.6, min | 87.0, min | 98, min |
| | Aviation Lean Rating | 100, min | | |
| D2699 | Research Octane Number | | | |
| D909 | Knock value, rich mixture | | | |
| | Octane Number | | | |
| | Performance number | 130, min | | |
| | COMPOSITION | | | |
| D2622 | Sulfur, mass % | 0.05, max | 0.07, max | 0.005, max |
| D5059 | Tetraethyl lead, mL | | | |
| | TEL/L | 0.53, max | | |
| | g Pb/L | 0.56, max | | 0.013, max |
| D2392 | Color | blue | | |
| | Dye content | | | |
| | Blue dye, mg/L | 2.7, max | | |
| | Yellow dye, mg/L | none | 2.8, max | |
| | Red dye, mg/L | none | | |
| | Orange dye, | mg/L | none | |
| | VOLATILITY | | | |
| D5191 | Vapor pressure, 38° C., kPa | 38-49 | 38-62 | 38-49 |
| D1298 | Density at 15° C., kg/m$^3$ | Report | Report | 730 max |
| D86 | Distillation | | | |
| | Initial Boiling Point. ° C. | Report | | Report |
| | Fuel Evaporated | | | |
| | 10, volume % at ° C. | 75, max | 70, max | 85, max |
| | 40, volume % at ° C. | 75, min | | 75, min |
| | 50, volume % at ° C. | 105, max | 66-121 | 105, max |
| | 90, volume % at ° C. | 135, max | 190 | 135, max |
| | Final boiling point, ° C. | 170, max | 225 | 170, max |
| | Sum of 10% + 50% evaporated | 135, min | | 135, max |
| | Recovery, volume % | 97, min | 95, min | 97, min |
| | Residue, volume % | 1.5, max | 2.0, max | 1.5, max |
| | Loss, volume % | 1.5, max | 3.0, max | 1.5, max |
| | Driveability Index | | | |
| | Observed Condition | | | |
| | FLUIDITY | | | |
| D2386 | Freezing Point, ° C. | −58, max | −58, max | −58, max |
| | CORROSION | | | |
| D130 | Corrosion, copper strip, 2 h @ | No. 1, max | No. 1, max | No. 1, max |
| | CONTAMINANTS | | | |
| D873 | Oxidation stability (5 h aging) | | | |
| | Lead Precipitate, mg/100 mL | 3, max | | |
| | Potential gum, mg/100 mL | 6, max | 6, max | 6, max |
| D1094 | Water reaction | | | |
| | Interface rating | | | |
| | Separation rating | | | |
| | Volume change, mL | ±2, max | | ±2, max |
| | OTHER | | | |
| D2624 | Electrical conductivity, 19.9° C., | 450, max | | 450, max |

The UL100R fuel is a 98+ octane unleaded aviation gasoline with up to 18% renewable content that meets most of the primary ASTM D910 parameters and offers the cleanest exhaust emissions. The base fuel contains no intentional aromatic hydrocarbons (e.g., toluene, xylene, and trimethylbenzenes) as these can increase the density of the fuel and thereby change the weight distribution of the aircraft. Certain embodiments do however allow up to 5% aromatics to improve octane performance. The preferred embodiment of UL100R without aromatics has a density identical to 100LL. The lower net heat of combustion may result in up to 5-8% less range in the aircraft; tests have indicated, however, that UL100R burns more completely than other unleaded fuel compositions, which may offset some of this loss of range.

UL100R has low overall toxicity due to the usage of gasoline components coupled with ETBE, which are not classified under OSHA's Acute Toxicity rating scale. The ETBE used in UL100R must satisfy the minimum quality requirements, as specified in ASTM D7618, Standard Specification for Ethyl Tertiary-Butyl Ether (ETBE) for Blending with Aviation Spark-Ignition Engine Fuel. In some embodiments, the fuel may also contain an additive of up to 250 ppm of ferrocene, a non-toxic iron-based octane booster. Research has indicated that ETBE alone, or in combination with certain alkylates, can in fact meet the anti-knock detonation requirements of piston engines without the use of octane boosters; however, with the addition of up to 250 ppm of ferrocene, the UL100R fuel can meet or exceed the minimum octane levels of 100LL.

The toxicity of ETBE was compared to other common components in aviation gasoline. Here below is a brief recap:

TABLE 3

| Component | $LD_{50}$ (rat, oral) | OSHA Hazards |
|---|---|---|
| Mesitylene | 5,000 mg/kg | Irritant |
| ETBE | 5,000 mg/kg | Irritant |
| Toluene | 5,000 mg/kg | Irritant, Teratogen, Reproductive hazard |
| Benzene | 2,990 mg/kg | Carcinogen, Mutagen, Irritant |
| Cumidine | 757 mg/kg | Irritant. Causes respiratory tract irritation. Causes eye and skin irritation. Can form methemoglobin, may cause cyanosis. May cause central nervous system depression. |
| m-Toluidine | 450 mg/kg | Toxic. Causes cyanosis. Harmful or fatal if inhaled, swallowed, or absorbed through skin. May be irritating to skin, eyes and mucous membranes. Target organs: Bladder; kidneys; blood; liver. |
| Aniline | 250 mg/kg | Carcinogen, toxic if swallowed, toxic in contact with skin, causes skin irritation, causes serious eye damage, fatal if inhaled, suspected of causing genetic defects. |
| Dibromoethane | 55 mg/kg | Carcinogen, toxic by inhalation, toxic by skin absorption. |
| TEL | 14 mg/kg | Carcinogen, toxic by inhalation, highly toxic by ingestion, highly toxic by skin absorption, teratogen. |

Source: SDS data from third-party compliance reports

This summary highlights the relative acute toxicity based on public data using $LD_{50}$ as an internationally accepted baseline. In addition, chronic effects from long term exposure and other effects like carcinogenicity, mutagenicity, and teratogenicity have to be considered for the objective evaluation of the fuel.

Another key factor is the relative concentration of potentially toxic components in a particular fuel formulation, e.g. certain aromatic amines may require 60 to 250 times the concentration level in a high-octane unleaded aviation fuel vs. TEL found in 100LL. See, Albuzat, T., *Understanding the Merits of* 1,3,5-*Trimethylbenzene*. Coordinating Research Council Aviation Meetings, Apr. 28, 2014, p. 6. For this reason, UL100R is tailored as a special non-toxic formulation with chemical components that exceed the bounds of OSHA standards for acute toxicity.

Pre-combustion: UL100R fuel is a flammable hydrocarbon liquid. It evaporates more quickly than 100LL. If exposed to the skin, it is only an irritant. With regard to ecological risks, UL100R is expected to persist in soil and water, and it degrades more slowly in the absence of oxygen, which is why proper industry-wide control of avgas tankage (leaks) is vital for acceptance of UL100R.

Post-combustion: UL100R is a clean-burning fuel with a much more complete combustion than 100LL due to the presence of oxygenates in the fuel. 100LL is known to emit rather white smoke containing toxic lead compounds like lead oxides and lead bromide. These lead emissions are not visible to the general population.

The composition of UL100R, being an oxygenated fuel, has pre- and post-combustion occupational exposure limits similar to those of automotive gasoline, which typically range from 25 ppm-300 ppm [TWA: 8 hours OSHA].

A basic component of the inventive fuel formulations is ETBE. The ETBE is used in an amount of about 20 to about 40 wt %, based on the overall weight of the formulation. In addition, a hydrocarbon component is included in an amount of about 60 to about 80 wt %. The hydrocarbon component is a constituent selected from the group consisting of C4-C10 aliphatic hydrocarbons, alkylates and alkanes. In some embodiments a portion of the hydrocarbon component is replaced with one or more other components selected from the group consisting of C6-C10 aromatic hydrocarbons, isobutane, ferrocene and cumidine. Preferably when both aromatic hydrocarbons and cumidine are present in the formulations, the aggregate of the aromatic hydrocarbons and of the cumidine is no greater than 5 wt %.

Cumidine refers to three isomeric liquid bases ($C_3H_7C_6H_4NH_2$) derived from cumene. It has been discovered that cumidine has unique properties for an aromatic amine related to high octane aviation gasoline. In the present invention, the isomer 4-isopropylaniline is preferably used.

In one embodiment, the fuel composition UL100R results in the performance properties specified herein. In the following formulas, the term "alkylates" is intended to also include separately C4-C10 aliphatic hydrocarbons. This fuel contains the following range of components by weight:

| | |
|---|---|
| (Iso) butane: | 0-3% |
| (bio-) ETBE: | 20-40% |
| Isooctane/Alkylates: | 50-75% |
| Aromatics Content: | 0-5% |

In a preferred embodiment, the formulation comprises, or consists essentially of, 52-80 wt % alkylates (or aliphatic hydrocarbons), 20-40 wt % ETBE, 0-5 wt % C6-C12 aromatic hydrocarbons, up to 3 wt % isobutane, and up to about 250 ppm ferrocene.

In a preferred embodiment, the formulation comprises, or consists essentially of, 58-78 wt % alkylates (or aliphatic hydrocarbons), 20-40 wt % ETBE, 2 wt % isobutane, and about 250 ppm ferrocene. In a preferred embodiment, the fuel formulation comprises, consists essentially of, or consists of 58 wt % isooctane, 40 wt % ETBE, and 2 wt % isobutane, and has a MON of about 100.

Another fuel composition of UL100R results in the performance properties specified in the table above. The fuel contains the following range of components, by mass:

| | |
|---|---|
| (Iso) butane: | 0-3% |
| (bio-) ETBE: | 20-40% |
| Isooctane/Alkylates: | 50-75% |
| Aromatics Content: | 0-5% |

Up to 250 ppm of ferrocene

For example, the fuel formulation comprises, consists essentially of, or consists of 58 wt % isooctane, 40 wt % ETBE, 2 wt % isobutane, and 250 ppm of ferrocene.

In another embodiment, the fuel composition and contains the following range of components, by mass:

| | |
|---|---|
| (Iso) butane: | 0-3% |
| (bio-) ETBE: | 20-40% |
| Isooctane/Alkylates: | 50-75% |
| Cumidine: | 0-5% |

In another example, the fuel formulation comprises, consists essentially of, or consists of 53 wt % isooctane, 40 wt % ETBE, 5% cumidine, and 2 wt % isobutane.

Due to the strict technical parameters outlined in D910, the UL100R fuel composition is tightly constrained by performance metrics, for example RVP, MON, and distillation curve. UL100R meets most of the performance characteristics of the ASTM International D910 aviation gasoline specification, as outlined below.

Combustion performance of UL100R, as measured by knock resistance during combustion, is as good as or better than that of 100LL. UL100 Renewable has a lower net heat of combustion by mass (40.8 MJ/kg) than 100LL (43.5 MJ/kg) because of the oxygenate content. Due to the similar density, the heat of combustion on a volumetric basis is actually 5-8% less than 100LL, however the combustion efficiency offsets this loss.

Fluidity is a critical operating parameter for flight safety. The fluidity of UL100R is consistent with 100LL, with a freezing point maximum of −58° C. The physical properties of the components in UL100R work together to meet the rigorous requirement necessary to ensure that fuel will continue to flow in a liquid state during high-altitude operations.

Volatility of the fuel is another critical operating parameter for reliability and flight safety. UL100R meets the traditional aviation gasoline standard of 38-49 kPa due to the presence of not more than 3% isobutane. Our tests reveal that fuels with (iso)butane concentrations higher than 3% will exceed the maximum vapor pressure limit and experience loss >1.5%. Fuels that are too volatile can experience vapor lock under normal operating conditions, or causing the engine not to start on the ground, or not restarting in an emergency situation at altitude.

Stability of UL100R is high due to the stable nature of the components. UL100R meets the strict oxidation stability requirements of ASTM D910 for 100LL but without the risk of lead precipitate, as it is an unleaded fuel. Due to the fact that UL100R is composed of all hydrocarbon components, it is water-insoluble.

Corrosion testing has shown that UL100R meets the strict D910 standard for accelerated soak testing of a copper strip.

Using a maximum quantity of 40% (m/m) bio-ETBE, UL100 Renewable achieves a Motor Octane Number of 98, which offers sufficient detonation protection with no aromatic content needed to enhance anti-knock performance. Due to the presence of oxygenates and iron in this formulation, it is anticipated that equivalent anti-knock performance will be achieved with a MON of 98+.

These formulations serve the entire piston-engine aviation fleet. This considers the needs of aircraft across the following range:

TABLE 4

Minimum Fuel Grade Distribution

| Min Fuel Grade | Number of Aircraft | Percent of 189,415 Aircraft (Rounded) |
|---|---|---|
| Minimum Grade 100LL | 82,034 | 43.3% |
| Minimum Grade 80 | 69,397 | 36.6% |
| Other Fuel | 17,508 | 9.2% |
| Minimum Grade 91 | 13,387 | 7.1% |
| Unknown, etc. | 5,302 | 2.8% |
| Unleaded 91/96 | 825 | 0.4% |
| 87 octane | 802 | 0.4% |
| Jet A | 147 | 0.1% |
| Minimum Grade 90 | 13 | 0.0068% |

Source: Crown Consulting, Inc.-General Aviation Piston Engine Fleet Assessment for Octane Requirement The fuels meet the varied needs of the engines that make up the piston-engine aviation fleet, including carbureted, fuel-injected, naturally-aspirated, turbocharged, supercharged, intercooled, low-compression, high-compression, horizontally-opposed, radial, in-line engines and V-configuration engines.

Preliminary testing in an engine test cell has indicated that UL100 Renewable achieved cold start at −20° C., and the engine performance results were "positive".

The fuels demonstrated the following properties. Cold Start: Both fuels started below −20° C. EGT: UL100 Renewable ran on average 25-50° C. hotter. CHT: UL100 Renewable ran on average 5-15° C. hotter. Fuel Consumption: ran equivalently for both fuels. This test experienced occasional misfires on 100LL, which reduced the EGT and CHT. Also note: in an unmodified engine, the Exhaust Gas Temperature is higher with UL100R because the oxygen in the fuel results in a leaner burn (i.e. a higher air-to-fuel ratio) thus a hotter temperature. Carburetor adjustments can easily compensate for the this affect.

L100R fuel is compatible with all existing aircraft materials, both metallic and nonmetallic. UL100R is compatible with the existing fleet and related supply chain infrastructure. Related to seal swell, certain engine manufacturers may advise that all aircraft and field infrastructure equipment that rely on Neoprene, Buna, or Vinyl Rubber materials be transitioned to Viton or Teflon materials (in most cases these parts are cheaper and have a longer service life). Based on test results, there is no immediate transition required for using UL100R, although this may be a prudent course of action for any aircraft being overhauled. Other alternatives that include certain aromatic amine components, because of their more aggressive nature toward the aforementioned materials and their tendency to reduce tensile strength, would require an immediate, pre-emptive change-out of Buna, Vinyl Rubber, and Neoprene components to satisfactory materials before those alternative fuels could see active service in the fleet or distribution infrastructure.

All 102-octane unleaded avgas candidates will face long-term material compatibility challenges related to Buna, Vinyl Rubber, and Neoprene. Testing on UL100R indicates that change-out of such materials may not be necessary until normal scheduled maintenance intervals, i.e., change-out is not a prerequisite for using UL100R.

The inventive fuels may "comprise" the described formulations, in which other components may be included. However, in a preferred embodiment, the inventive fuels "consist of" the described formulations, in which no other components are present. In addition, the inventive fuels may "consist essentially of" the formulations, in which case other fuel excipients may be included. As used herein, the term "fuel excipients" refers to materials which afford improved performance when used with fuels, but which do not directly participate in the combustion reactions. Fuel excipients thus may include, for example, antioxidants, etc.

The formulations are also useful for combining with other fuel components to form blends that are useful as motor fuels, including as aviation gasoline. As used herein, the term "fuel components" refers to materials which are themselves combustible and have varying motor octane ratings and are included primarily to provide improved combustion characteristics of the blend. In preferred embodiments, such fuel components are present in the blend at less than 5 wt %, and more preferably less than 1 wt %.

Blending of the formulations herein can be performed in any suitable order. No language in the specification should be construed as indicating any non-claimed element as essential to the practice of the invention.

Most grades of avgas have historically contained tetraethyl lead (TEL), a toxic substance used to prevent engine knocking (detonation). This invention produces an unleaded grade of avgas with fuel properties that meet minimum power rating (motor octane number), appropriate combustion anti-knocking (detonation suppression), volatility (vapor pressure), and related criteria. The inventive fuels allow a range of piston engine aircraft, including those with high-compression engines, to perform effectively to manufacturer requirements. It is necessary that avgas provide sufficient power under varying conditions, including take-off and climb as well as at cruise.

Tetraethyl lead, abbreviated TEL, is an organolead compound with the formula $(CH_3CH_2)_4Pb$. It has been mixed with gasoline since the 1920's as an inexpensive octane booster which allowed engine compression to be raised substantially, which in turn increased vehicle performance and fuel economy. Over the years, certain of these leaded fuel grades have been referred to as low lead, or "LL". One advantage of TEL is the very low concentration needed. Other anti-knock agents must be used in greater amounts than TEL, often reducing the energy content of the gasoline. However, TEL has been in the process of being phased out since the mid-1970s because of its neurotoxicity and its damaging effect on catalytic converters. Most grades of avgas have historically contained TEL. This invention advantageously produces an unleaded grade of gasoline which allows a range of piston engines to perform effectively. Therefore, in a preferred embodiment the inventive formulations and blends are unleaded, i.e., free of TEL. It is an object of the present invention to provide formulations that do not require deleterious octane boosters, and which meet or exceed requirements for aviation gasoline.

A variety of fuel additives have been known and used in the art to increase octane ratings, and thereby reduce knocking. Some embodiments of the present invention utilize non-leaded combustion enhancing additives individually or in combination with up to 6% by weight, esters, ethers, carbonates, C5-C7 cycloalkanes, or the use of triptane and other known octane boosters.

Fuel components typically are not chemically pure, but instead may contain other, non-deleterious fuel components. The term "non-deleterious fuel components" refers to components which are present in a formulation other than as an intended component. Thus, selected additives such as mentioned above are not encompassed by this term. Instead, it refers more particularly to the fact that materials used in commercial embodiments of piston engine fuels may include constituents, e.g., hydrocarbons, which are present as contaminants to the components of primary interest. For example, an alkylate stream from a refinery may be primarily composed of desired alkanes such as isobutane or isooctane, but may contain limited amounts of other hydrocarbons such as aromatic hydrocarbons. As used herein, the term "substantially free of" refers to the fact that the amount of such non-deleterious fuel components is less than about 5 wt %, preferably less than 2 wt % and more preferably less than 0.5 wt %, of the weight of the overall fuel formulation.

Thus, the fuel formulations may include a limited amount of aromatic hydrocarbons, e.g., toluene, xylene, trimethylbenzenes, etc. These compounds are frequently found in minor amounts in product streams useful for the present formulations. Moreover, in preparing fuels it is not economical to use analytical grade or reagent grade chemicals, or even technical grade chemicals, as the presence of other fuel-compatible components is not a concern, provided the resulting fuel formulation meets ASTM and other applicable standards. Thus, the present invention contemplates the presence of such other fuel-compatible components in limited amounts, e.g., less than 5 wt %, preferably less than 2 wt %, and more preferably less than 1 wt %.

All component percentages expressed herein refer to percentages by weight of the formulation, unless indicated otherwise. Given the similarity of the densities of the components of the present invention, it will be appreciated that the use of volume or weight percentages of the components in the ranges indicated provides comparable results.

The uses of the terms "a" and "an" and "the" and similar references in the context of describing the invention (especially in the context of the following claims) are to be construed to cover both the singular and the plural unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected. In addition, all references cited herein are indicative of the level of skill in the art and are hereby incorporated by reference in their entirety.

The invention claimed is:

1. A piston engine fuel formulation comprising:

50 to 80 wt % $C_4$-$C_{12}$ alkylates;

20 to 40 wt % ETBE; and isobutane in an amount up to about 3 wt %;

said fuel formulation being substantially free of $C_6$-$C_{12}$ aromatic hydrocarbons and being free of lead-containing constituents, said fuel formulation having a MON of at least 96.

2. The fuel formulation of claim 1 consisting essentially of:

57 to 80 wt % $C_4$-$C_{12}$ alkylates;

20 to 40 wt % ETBE; and isobutane in an up to 3 wt %.

3. A piston engine fuel formulation comprising:

58 to 78 wt % isooctane;

20 to 40 wt % ETBE; and 2 wt % isobutane, said fuel formulation being substantially free of $C_6$-$C_{12}$ aromatic hydrocarbons and being free of lead-containing constituents, said fuel formulation having a MON of at least 96.

4. The fuel formulation of claim 3 consisting essentially of:

58 to 78 wt % isooctane;

20 to 40 wt % ETBE; and 2 wt % isobutane.

5. The fuel formulation of claim 3 consisting of:

58 to 78 wt % isooctane;

20 to 40 wt % ETBE; and 2 wt % isobutane.

6. The fuel formulation of claim 3 comprising:

58 wt % isooctane;

40 wt % ETBE; and 2 wt % isobutane, said fuel formulation having a MON of about 101.0.

7. The fuel formulation of claim 3 consisting essentially of:

58 wt % isooctane;

40 wt % ETBE; and 2 wt % isobutane.

8. The fuel formulation of claim 3 consisting of:

58 wt % isooctane;

40 wt % ETBE; and 2 wt % isobutane.

* * * * *